United States Patent [19]

Ueda et al.

[11] Patent Number: 5,022,123

[45] Date of Patent: Jun. 11, 1991

[54] DRAFT MECHANISM HAVING ROLLER PAIRS CONNECTED TO DRAFT RATIO CONTROLLED MOTORS BY TIMING BELTS

[75] Inventors: Yutaka Ueda, Nara; Hideshi Mori, Joyo; Manzo Tanaka, Oumihachiman, all of Japan

[73] Assignee: Murata Kikai Kabushiki Kaisha, Kyoto, Japan

[21] Appl. No.: 413,987

[22] Filed: Sep. 28, 1989

[30] Foreign Application Priority Data

Sep. 29, 1988 [JP] Japan ..... 63-245425
Jun. 16, 1989 [JP] Japan ..... 1-70690[U]

[51] Int. Cl.[5] ..... D01H 5/32; D01H 5/44; D01H 5/34

[52] U.S. Cl. ..... 19/260; 19/244; 19/258; 19/261; 19/240; 19/293; 19/236

[58] Field of Search ..... 19/152, 153, 236, 240, 19/241, 242, 244, 254, 255, 256, 260, 261

[56] References Cited

U.S. PATENT DOCUMENTS 2,812,553 11/1957 Coulliette ..... 19/293 X
3,105,998 10/1963 Raboisson ..... 19/260 X
3,778,995 12/1973 Sanders ..... 19/244 X
4,512,061 4/1985 Hartmannsgruber ..... 19/240 X
4,589,168 5/1986 Kreiger ..... 19/258 X
4,703,431 10/1987 Sako ..... 19/240 X
4,727,626 3/1988 Vinas ..... 19/244
4,819,301 4/1989 Konig ..... 19/240

FOREIGN PATENT DOCUMENTS 3517614 11/1985 Fed. Rep. of Germany ..... 19/236
0349831 7/1988 Fed. Rep. of Germany ..... 19/293
0524695 8/1972 Switzerland .
2062712 5/1981 United Kingdom .

*Primary Examiner*—Werner H. Schroeder
*Assistant Examiner*—Ismael Izaguirre
*Attorney, Agent, or Firm*—Spensley Horn Jubas & Lubitz

[57] ABSTRACT

A draft mechanism for use on a spinning machine includes a series of roller pairs each including a bottom roller and a top roller. The roller pairs are connected to output shafts of motors through the use of timing belts. The motors are electrically controlled according to the draft ratios. Roller gauge adjusting shafts are meshed with bearing portions of the top and bottom rollers.

12 Claims, 5 Drawing Sheets

DRAFT MECHANISM HAVING ROLLER PAIRS CONNECTED TO DRAFT RATIO CONTROLLED MOTORS BY TIMING BELTS'

FIELD OF THE INVENTION

The present invention relates to a draft mechanism for use on a spinning machine and more particularly relates to a draft mechanism which is capable of electrically controlling the draft ratios.

RELATED ART STATEMENT

The conventional draft mechanism usually includes, as shown in FIG. 3, a back roller pair consisting of a back bottom roller 1*a* and a back top roller 1*b*, a middle roller pair 3 consisting of a middle bottom roller 3*a* and a middle top roller 3*b*, and a front roller pair 4 consisting of a front bottom roller 4*a* and a front top roller 4*b*. A spinning machine provides a number of draft mechanisms of this sort in series on a machine frame. Although omitted in the drawings, rotation is transmitted to the respective rollers from a line shaft which is driven by a main motor and coupled with the respective bottom rollers, namely, with the back, middle and front bottom rollers 1*a*, 3*a* and 4*a* through a transmission mechanism including belts, chains, gears and so forth, stepping up the rotational speed in the order of the back rollers pair 1, middle roller pair 3 and front roller pair 4 to draft a sliver, which is supplied to the back roller pair 1, to a predetermined thickness until it reaches the front roller pair 4.

Therefore, the transmission of rotation from the line shaft to the respective bottom rollers involves back-lashes caused by the belts, chains, gears and the like, resulting in non-uniform drafting.

In addition, for alteration of draft ratio, the conventional mechanism requires complicated operations including changes of gear ratios and replacements of belts, chains and the like.

Therefore, the alteration of draft ratios require extremely troublesome efforts and meticulous skill, in addition to a need for the provision of a diversity of expensive gears of high precision machining to cope with various draft ratios.

OBJECT AND SUMMARY OF THE INVENTION

It is an object of the present invention to provide a draft mechanism which eliminates the back-lashes caused by belts, chains or gears during the transmission of rotation from the line shaft to the respective draft rollers, thereby precluding irregularities in drafting, while facilitating alterations of draft ratio.

According to the an embodiment of the present invention, there is provided a draft mechanism having a series of roller pairs each consisting of a bottom roller and a top roller, characterized in that the roller pairs have the respective bottom rollers separately and directly connected to the output shafts of motors, and the draft mechanism further includes a motor controller having a memory device for storing rotational speeds of the individual motors beforehand and adapted to control the respective motors according to signals supplied from the memory device.

The middle bottom roller may be driven and controlled by an apron which is surrounding around the middle bottom roller and an output shaft of a motor for the middle rollers.

In accordance with an embodiment of the present invention, there may be provided a draft mechanism comprising roller drive motors arranged to separately rotate bottom rollers of the respective sets of draft rollers each through a timing belt, and a controller for controlling rotational speeds of the respective roller drive motors.

DETAILED DESCRIPTION OF PREFERRED EMBODIMENTS

The present invention is described with reference to the drawings which show preferred embodiments of the invention.

Figure 1:
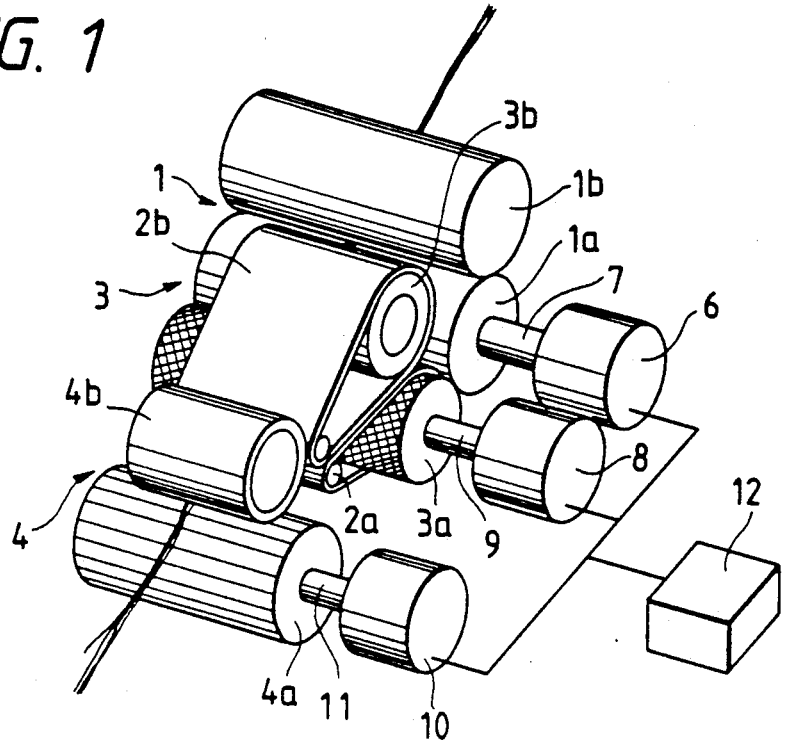
FIG. 1 is a perspective view of a draft mechanism according to a first embodiment of the present invention.

Referring to FIG. 1, there is illustrated a draft mechanism according to a first embodiment of the invention, which includes, similarly to the conventional draft mechanism, a back roller pair 1 consisting of a back bottom roller 1*a* and a back top roller 1*b*, a middle roller pair 3 consisting of a middle bottom roller 3*a* and a middle top roller 3*b* having aprons 2*a* and 2*b* surrounding therearound, and a front roller pair 4 consisting of a front bottom roller 4*a* and a front top roller 4*b*. A number of drafting mechanisms of this arrangement are likewise mounted in series on a machine frame to constitute a spinning machine In this first embodiment, however, the back bottom roller 1*a* of the back roller pair 1, the middle bottom roller 3*b* of the middle roller pair 3 and the front bottom roller 4*b* of the front bottom roller pair 4 are directly coupled with output shafts 7, 9 and 11 of motors 6, 8 and 10, respectively.

These motors are controlled by a controller 12 which includes a memory device for storing the rotational speeds of the respective motors and which controls the speeds of the motors according to the memory contents. More specifically, while storing the predetermined rotational speeds of the back, middle and front roller pairs 1, 3 and 4 for various draft ratios in the memory device, the memory contents corresponding to a desired draft ratio are taken out for each drafting operation, supplying signals from the memory device to the motor controller to operate same in such a manner as to control the respective motors to predetermined suitable rotational speeds.

In FIG. 1, the motors 5, 7 and 9 for the back, middle and front roller pairs 1, 3 and 4 are located side-by-side on the same side of the machine. However, in a case where the back, middle and front roller pairs 1, 3 and 4 are spaced too closely to each other to locate the motors side-by-side in tandem fashion, the output shaft 9 of the motor 8 for the middle roller pair 3 may be extended to locate the motor 8 in a staggered position or alternatively the motor 8 may be located on the opposite side of the machine (on the left side in FIG. 1).

A control device 12 for the motors 6, 8 and 10 shown in FIG. 1 will be described in detail.

Figure 4:
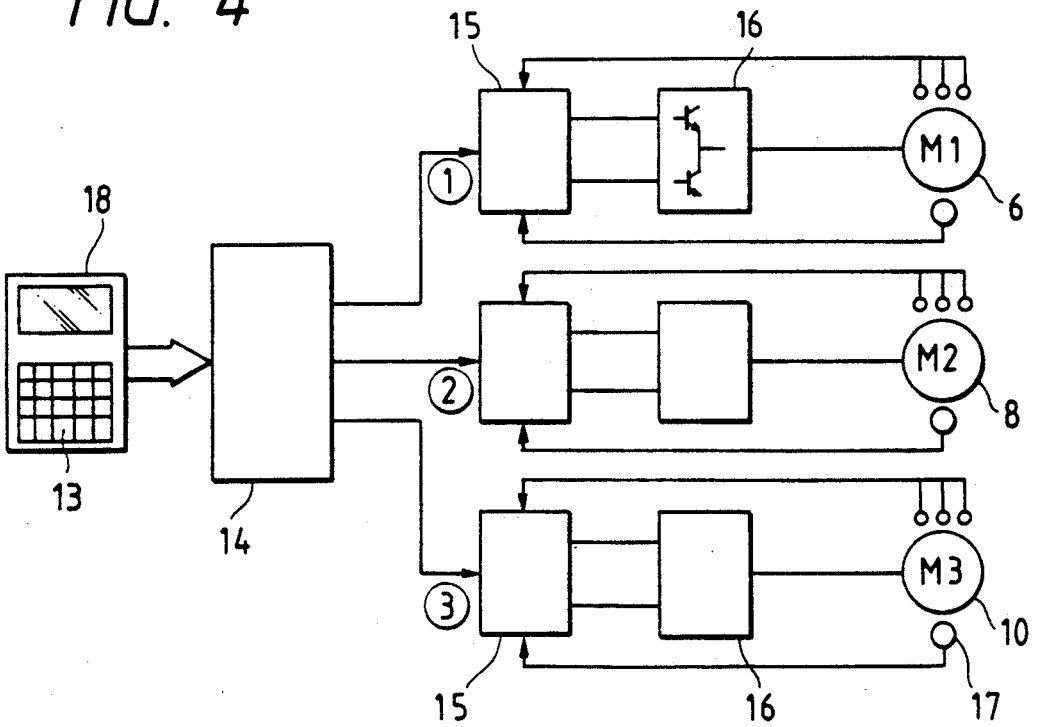
FIG. 4 is a schematic block diagram showing a controller for motors.

In FIG. 4, a setting of a draft ratio and a setting of a spinning speed are carried out in the setting unit 13 having a display device 18. That is, the setting unit 13 is applied as a calculation control unit 14, a draft ratio between the motors M1 and M2 and a draft ratio between the motor M2 and M3 are inputted and a spinning speed of the motor M3 is set to make the speed instructions (1), (2) and (3), respectively.

Reference numeral 15 denotes a micro-computer, 16 a motor driver and 17 an encoder.

Figure 5:
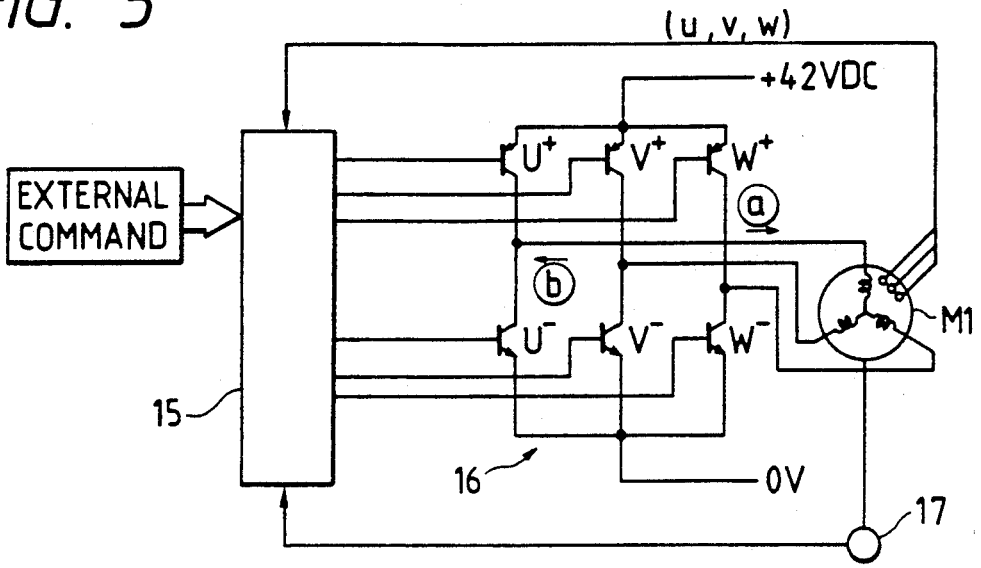
FIG. 5 is a circuit diagram for controlling a motor.

FIG. 5 is a control circuit diagram for one motor (for example, the motor Ml) shown in FIG. 4.

Figure 6A:
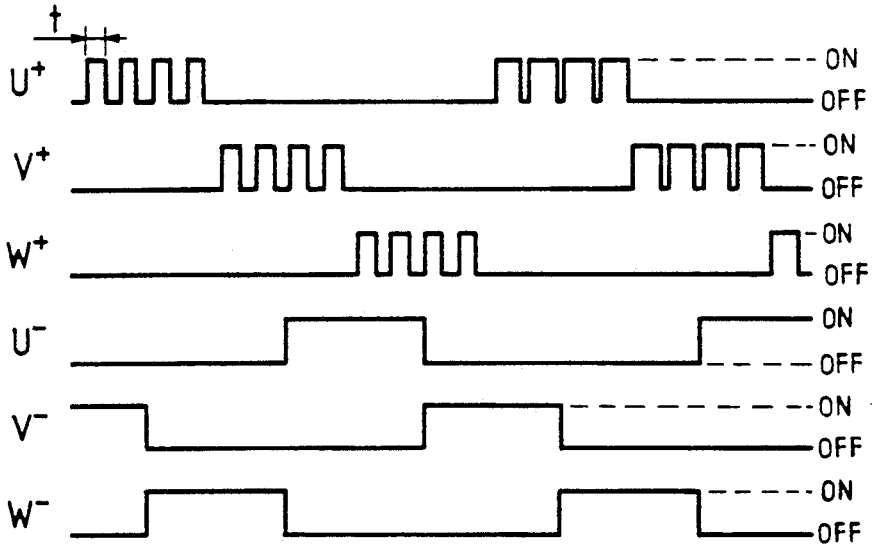
FIG. 6*a* is a timing chart of transistors.

In the timing chart shown in FIG. 6*a*, signals U+ to W− denote an ON-OFF state of each of the transistors and an H-level indicated an ON-state of the transistor and an L-level indicates an OFF-state of the transistor. Three signals up to U+ to W+ may repeat an ON and an OFF in a short period in case of H-level. Either increasing or decreasing the time (t) of this H-level enables an amount of energization to be controlled and an acceleration or deceleration of the motor can be performed.

Figure 6B:
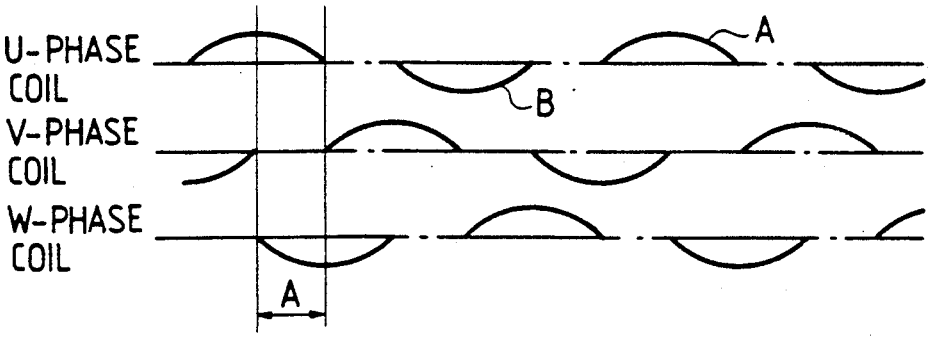
FIG. 6*b* is a diagram showing excitation of motor coils.

In FIG. 6*b*, each of the signals in each of the coils U-phase, V-phase and W-phase denotes an energized condition for each of the phases in the coil of the motor. In case that the signal is present above a central line, an electric current is flowed in a direction of current flowing into the motor and in turn in case that the signal is present below the central line, the electrical current is flowed in a direction of current flowing out of the motor. Accordingly, in case of the part A shown in the figure, the electrical current flows in a path of +42 VDC - U-phase coil - W-phase coil - OV. (FIG. 5)

In the present controller, a motor speed is detected by an encoder and the above-mentioned (t) is increased or decreased in such a way as the motor speed is coincided with a speed under an external command, and then the motor speed is accelerated or decelerated.

A timing of energization for each of the U-phase, V-phase and W-phase coils is determined in response to rotor position sensing signals u, v and W.

Figure 2:
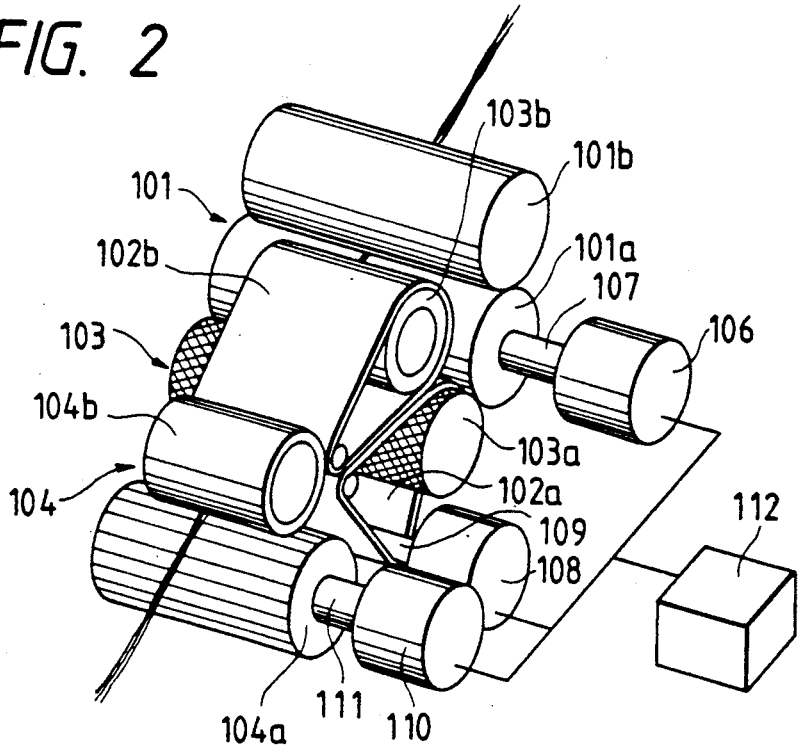
FIG. 2 is a perspective view of a second embodiment of the invention.
Figure 3:
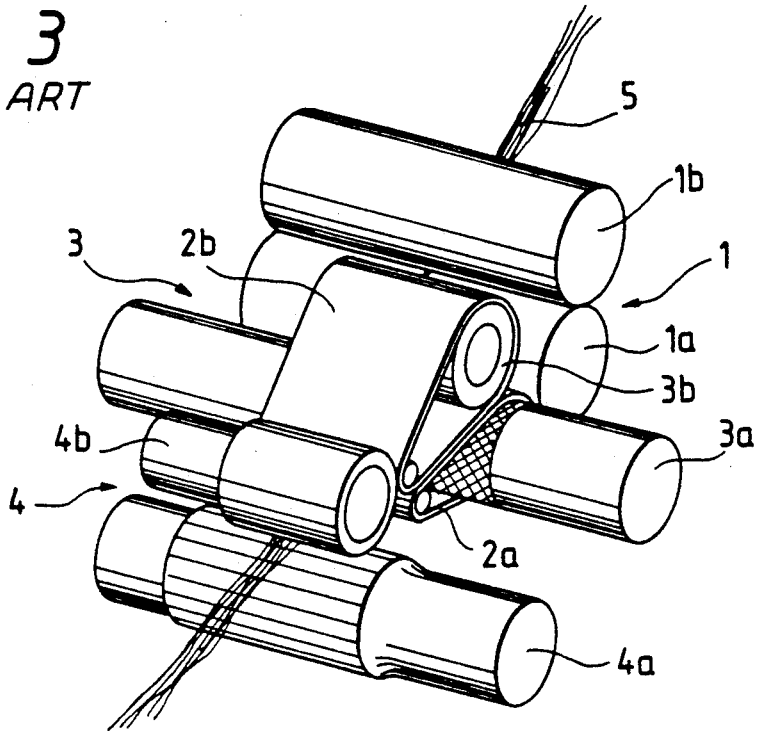
FIG. 3 PRIOR ART
FIG. 3 is a perspective view of a conventional draft mechanism.

Illustrated in FIG. 2 is a second embodiment of the invention, which is an example where the back, middle and front roller pairs 101, 103 and 104 are located closely to each other to make the tandem positioning of the motors difficult. In this case, the apron 102*a* which is expanded around the middle bottom roller 103*a* in the foregoing embodiment is expanded around both the middle bottom roller 103*a* and the output shaft 109 of the motor 108 to function as a drive belt for the middle bottom roller 103*a* in addition to its original function as an apron, and the motor 108 is located in a position lower than the motors 106 and 110.

In other respects, the mechanism of this embodiment has the same construction and operational effects as the above-described first embodiment.

Thus, according to an embodiment of the present invention, there is provided a draft mechanism having a series of roller pairs each comprising of a bottom roller and a top roller, in which the roller pairs have the respective bottom rollers separately and directly connected to the output shafts of motors, and the draft mechanism further includes a motor controller having a memory device for storing rotational speeds of the individual motors beforehand and adapted to control the respective motors according to signals supplied from the memory device. According to another embodiment of the present invention, there is provided a drafting apparatus having a series of roller pairs each consisting of a bottom roller and a top roller, in which the roller pairs have the respective bottom rollers separately and directly connected to the output shafts of motors except a middle bottom roller, which middle bottom roller being connected to an output shaft of another motor by an apron expanding therebetween, and the draft mechanism further includes a motor controller having a memory device for storing rotational speeds of the individual motors beforehand and adapted to control the respective motors according to signals supplied from the memory device. Accordingly, it becomes possible to transmit rotation securely to the back roller, bottom roller and front roller free of back-lashes as experienced when transmitting rotation from the line shaft to the back, middle and front bottom rollers through a transmission mechanism using belts, chains, gears or the like, thus precluding irregularities in drafting. Besides, the draft ratio can be altered correctly in a simplified manner through control of the memory device, without entailing the complicate operations as conventionally required for replacement of belts, chains, gears or the like.

Furthermore, according to the draft mechanism of an embodiment of the present invention, it becomes possible to drive and control the draft ratios of a number of groups of draft mechanisms which are mounted in series on a machine frame for producing different types of threads independently of each other by the respective groups on a single spinning machine.

According to a third embodiment of the present invention, there may be provided a draft mechanism comprising roller drive motors arranged to separately rotate bottom rollers of the respective sets of draft rollers each through a timing belt and a controller for controlling rotational speeds of the respective roller drive motors.

Hereafter, the invention is described with reference to the drawings showing the third embodiment of the invention, a 4-line type draft mechanism.

Needless to say, the invention is not restricted to the 4-line type draft mechanism shown.

Figure 7:
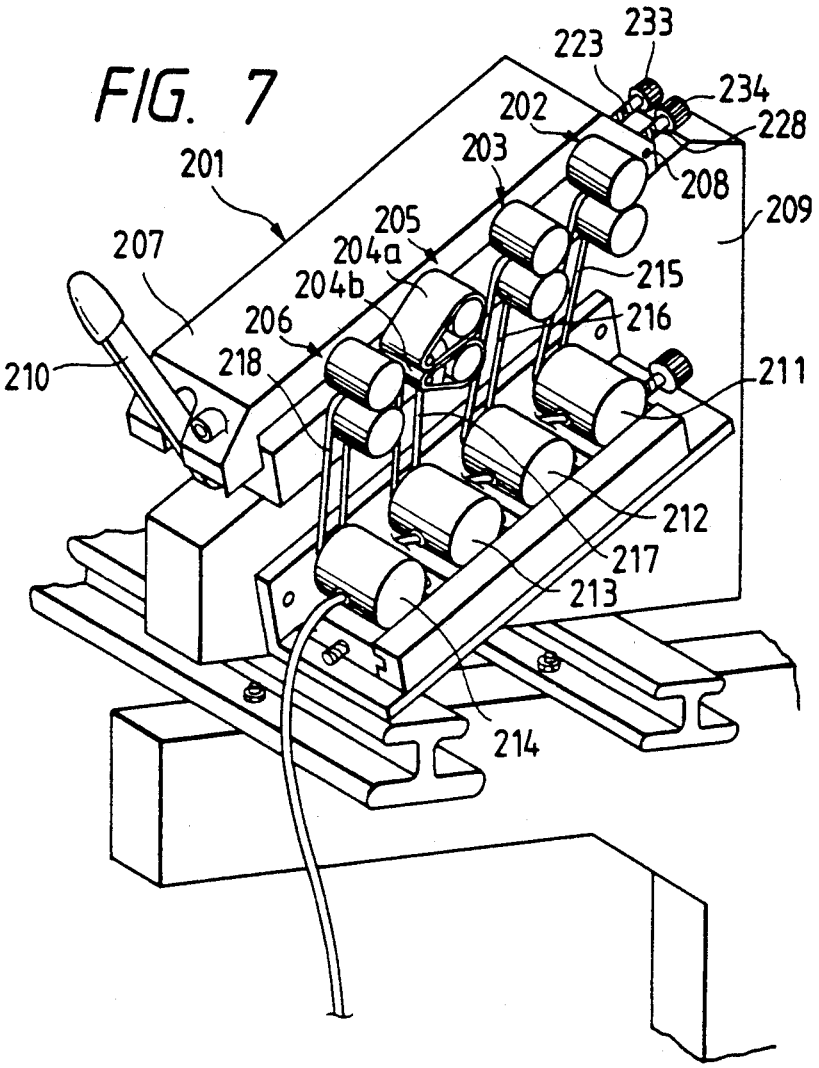
FIG. 7 is a perspective view of a draft mechanism according to the third embodiment of the present invention.
Figure 8:
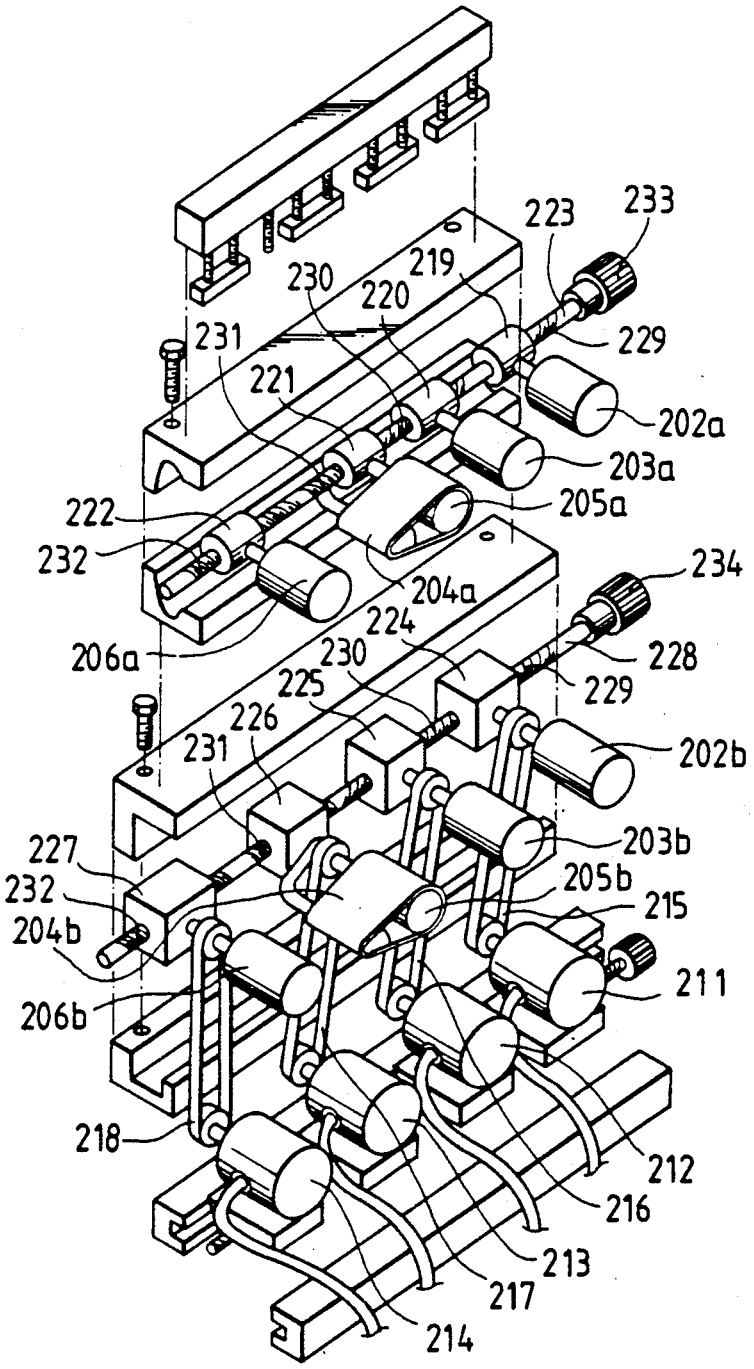
FIG. 8 is a perspective view of a mechanism in partially assembled state.

The 4-line type draft mechanism according to the embodiment, which is shown in an assembled view in FIG. 7 and in an exploded or disassembled view in FIG. 8, is constituted by a pair of top and bottom back rollers 202, a pair of top and bottom third rollers 203 of similar construction, a pair of top and bottom second rollers 205 having aprons 204*a* and 204*b* expanded therearound, and a pair of top and bottom front rollers 206. The rotational speed is stepped up in the order of the back rollers 202, third rollers 203, second rollers 205 and front rollers 206 thereby to form a thread by drafting a sliver which is fed to the back rollers 202 from a can, not shown, through a trumpet guide, taking up the thread by a take-up device to form a package.

As shown particularly in FIG. 8, the top roller 202*a* of the back rollers 202, the top roller 203*a* of the third rollers 203, the top roller 205*a* of the second rollers 205 with the aprons 204*a* and 204*b*, and the top roller 206*a* of the front rollers 206 are all rotatably supported on a shaft within a cradle cover 207 as shown in FIG. 7. The cradle cover 207 is pivotally supported by a support rod 208 at its one end on the side of the back top roller 202*a*. The support rod 208 is fixed on a top frame 209 through angles.

At the end on the side of the front top roller 206*a*, the draft cradle cover 207 is provided with a cradle hook handle 210. When the cradle hook handle 210 is operated to engage the draft cradle cover 207 with a locking portion of the top frame 209, the back top roller 202*a*, third top roller 203*a*, second top roller 205*a* with the apron 204*a* and the front top roller 206*a* are pressed against the back bottom roller 202*b*, the third bottom roller 203*b*, the middle bottom roller 205*b* with the apron 204*b* and the front bottom roller 206*b*, respectively, which are mounted on the top frame 209 to form a draft mechanism.

On the other hand, when the cradle hook handle 210 is operated to release the draft cradle cover 207, the latter can be turned about the support rod 208 to release the top rollers from the pressed engagement with the respective bottom rollers.

The back bottom roller 202*b*, third bottom roller 203*b*, second bottom roller 205*b* and front bottom roller 206*b* are independently rotated by motors 211 to 214 through flexible connectors comprising timing belts 215 to 218 which are passed therebetween, forming a thread by drafting a sliver gripped between the bottom rollers and the top rollers which are pressed against the opposing bottom rollers.

In this embodiment, the draft mechanism of the above-described construction is provided with a single roller gauge adjusting shaft 223 which meshes with bearing portions 219 to 222 of the back top roller 202*a*, third top roller 203*a*, second top roller 205*a* and front top roller 206*a* in an intersecting relation with the roller shafts thereof, and a single roller gauge adjusting shaft 228 which meshes with bearing portions 224 to 227 of the back bottom roller 202*b*, third bottom roller 203*b*, second bottom roller 205*b* and front bottom roller 206*b* in an intersecting relation with the roller shafts thereof.

These roller gauge adjusting shafts 223 and 228 are exactly same in construction, and provided with a coarse-pitch left-hand screw portion 229 which intersects the roller shafts of the back rollers, fine-pitch left-hand screw portion 230 which intersects the roller shafts of the third rollers 203, a fine-pitch right-hand screw portion 231 which intersects the roller shafts of the second rollers 205, and a coarse-pitch right-hand screw portion 232 which intersects the roller shafts of the front rollers 206.

Accordingly, for adjusting the roller gauges of the respective draft rollers depending upon the kind of the sliver and the fiber length, the knobs 233 and 234 of the roller gauge adjusting shafts 223 and 228 are turned to move the roller shaft bearing portion 219 to 222 and 224 to 227 along the screw portions of the roller shaft gauge adjusting shafts 223 and 228. As a result, the roller positions are shifted to establish desired roller gauges.

In the roller gauge adjustment, the timing belts 215 to 218 are elastically stretched or shrunk, absorbing variations in tension, so that there is no need for changing the positions of the motors 211 to 214.

Figure 9:
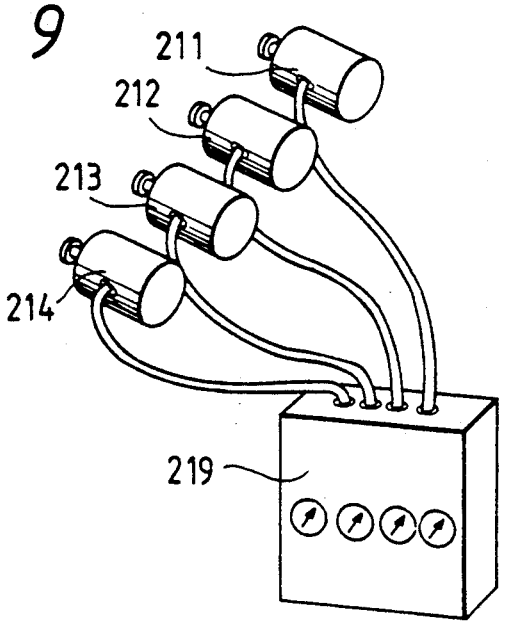
FIG. 9 is a perspective view showing a relationship between the motors and controller.

Further, as shown particularly in FIG. 9, the motors 211 to 214 are connected to the controller 219, which controls the rotational speeds of the respective motors, for example, by control of an inverter, to effect the drafting at an optimum draft ratio in reference to preset total draft ratio, main draft ratio and feed draft ratio which have been determined beforehand on the basis of the kind and length of the sliver fiber.

As described in detail hereinbefore, the draft mechanism of this embodiment is provided with roller drive motors arranged to separately rotate bottom rollers of the respective sets of draft rollers each through a timing belt, and a controller for controlling rotational speeds of the respective roller drive motors. The motors which rotate the respective draft rollers are controlled by signals from the controller, rotating the draft rollers in such a manner as to establish a desired draft ratio. Therefore, the mechanism can cope with productions of various kinds of threads without necessitating to disassemble the machine or to employ complicated means over a long period of time for the purpose of adjustments. Besides, there is no need for providing spare parts for the gear box and line shaft. Thus, the invention not only permits a cost reduction and free alterations of the draft ratio but also contributes to a reduction of the number of steps in manufacturing process and an improvement in productivity.

What is claimed is:

1. A draft mechanism having a series of roller pairs each comprising a bottom roller and a top roller, wherein said roller pairs have respective bottom rollers separately connected to the output shafts of motors through respective timing belts, and said draft mechanism comprises a motor controller having a memory device for storing rotational speeds of the individual motors beforehand and adapted to control the respective motors according to signals supplied from said memory device.

2. A draft mechanism as claimed in claim 1, wherein a first roller gauge adjusting shaft intersects with a roller shaft of the top roller of the roller pairs, and meshes with a bearing portion of the roller shaft of each top roller, and a second roller gauge adjusting shaft intersects with a roller shaft of the bottom roller of the roller pairs, and meshes with a bearing portion of the roller shaft of each bottom roller, 50 that roller gauges of the respective draft rollers are adjusted by turning the first and second roller gauge adjusting shafts to move each bearing portion therealong.

3. A draft mechanism as claimed in claim 1, wherein said motor controller comprises a setting unit for setting a draft ratio and setting a spinning speed and a display device, said setting unit being applied as a calculation control unit providing microcomputers, motor drivers and encoders corresponding to the individual motors.

4. A draft mechanism comprising:

first and second roller pairs, each roller pair having a bottom roller and a top roller;

first and second roller drive devices;

a first flexible connector connecting the first roller drive device to at least one of the top and bottom rollers of the first roller pair;

a second flexible connector connecting the second roller drive device to at least one of the top and bottom rollers of the second roller pair;

control means, having a memory device for storing information corresponding to rotational speeds of the first and second roller drive devices, for controlling the first and second roller drive devices according to information stored by the memory device, wherein the first and second flexible connectors comprise first and second belts, respectively.

5. A draft mechanism as claimed in claim 4, wherein the first flexible connector is connected to the first roller drive device independently of the connection of the second flexible connector with the second roller drive device.

6. A draft mechanism as claimed in claim 4, wherein the first and second roller drive devices each comprise a motor and an output shaft rotatably driven by the motor, and wherein the first and second flexible connectors are connected to the output shafts of the first and second roller drive devices, respectively.

7. A draft mechanism as claimed in claim 4, wherein the control means comprises:

an input unit for inputting a desired draft ratio: and a calculation control unit for providing the first and second roller drive devices with speed instruction signals dependant on the inputted draft ratio.

8. A draft mechanism comprising:

first and second roller pairs, each roller pair having a bottom roller and a top roller;

first and second roller drive devices;

a first flexible connector connecting the first roller drive device to at least one of the top and bottom rollers of the first roller pair;

a second flexible connector connecting the second roller drive device to at least one of the top and bottom rollers of the second roller pairs;

control means, having a memory device for storing information corresponding to rotational speeds of the first and second roller drive devices, for controlling the first and second roller drive devices according to information stored by the memory device; and adjusting means for adjusting the relative distance between the first roller pair and the second roller pair.

9. A draft mechanism as claimed in claim 8, wherein each of the top and bottom rollers of the first and second roller pairs have a roller shaft provided with a bearing portion, the adjusting means comprising:

a first roller gauge adjusting shaft meshed with the bearing portions of the top rollers of the first and second roller pairs;

a second roller gauge adjusting shaft meshed with the bearing portions of the bottom rollers of the first and second roller pairs; and first and second knobs connected to the first and second roller gauge adjusting shafts, respectively, for selectively rotating the first and second roller gauge adjusting shafts to move the bearing portions along a length of the roller gauge adjusting shafts.

10. A draft mechanism comprising:

first and second roller pairs, each roller pair having a bottom roller and a top roller;

first and second roller drive devices;

a first flexible connector connecting the first roller drive device to at least one of the top and bottom rollers of the first roller pair;

a second flexible connector connecting the second roller drive device to at least one of the top and bottom rollers of the second roller pair;

control means, having a memory device for storing information corresponding to rotational speeds of the first and second roller drive devices, for controlling the first and second roller drive devices according to information stored by the memory device, wherein each of the top and bottom rollers of the first and second roller pairs have a roller shaft provided with a bearing portion, the draft mechanism further comprising:

a first roller gauge adjusting shaft meshed with the bearing portions of the top rollers of the first and second roller pairs;

a second roller gauge adjusting shaft meshed with the bearing portions of the bottom rollers of the first and second roller pairs; and first and second knobs connected to the first and second roller gauge adjusting shafts, respectively, for selectively rotating the first and second roller gauge adjusting shafts to move the bearing portions along the length of the roller gauge adjusting shafts.

11. A draft mechanism comprising:

first and second roller pairs, each roller pair having a bottom roller and a top roller;

first and second roller drive devices;

a first belt connecting the first roller drive device to at least one of the top and bottom rollers of the first roller pair;

a second belt connecting the second roller drive device to at least one of the top and bottom rollers of the second roller pair; and adjusting means for adjusting the relative distance between the first roller pair and the second roller pair.

12. A draft mechanism as claimed in claim 11, wherein each of the top and bottom rollers have a roller shaft provided with a bearing portion, the adjusting means comprising:

a first roller gauge adjusting shaft meshed with the bearing portions of the top rollers of the first and second roller pairs;

a second roller gauge adjusting shaft meshed with the bearing portions of the bottom rollers of the first and second roller pairs; and first and second knobs connected to the first and second roller gauge adjusting shafts, respectively, for selectively rotating the first and second roller gauge adjusting shafts to move the bearing portions along the length of the roller gauge adjusting shafts.

* * * * *